US009127434B2

(12) United States Patent
Shiratani et al.

(10) Patent No.: US 9,127,434 B2
(45) Date of Patent: Sep. 8, 2015

(54) ELECTRICAL SWIVEL WORKING MACHINE

(71) Applicant: SUMITOMO(S.H.I.) CONSTRUCTION MACHINERY CO., LTD., Tokyo (JP)

(72) Inventors: Ryuji Shiratani, Chiba (JP); Kiminori Sano, Chiba (JP); Ryota Kurosawa, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 69 days.

(21) Appl. No.: 14/165,920

(22) Filed: Jan. 28, 2014

(65) Prior Publication Data

US 2014/0241842 A1 Aug. 28, 2014

(30) Foreign Application Priority Data

Feb. 26, 2013 (JP) ..... 2013-036296

(51) Int. Cl.
*E02F 9/12* (2006.01)
*E02F 9/20* (2006.01)

(52) U.S. Cl.
CPC ..... *E02F 9/123* (2013.01); *E02F 9/2075* (2013.01)

(58) Field of Classification Search
CPC ..... E02F 9/123; E02F 9/2075
USPC ..... 701/3; 414/744.2
See application file for complete search history.

(56) References Cited

U.S. PATENT DOCUMENTS

2002/0070056 A1* 6/2002 Wilcox ..... 180/6.7

FOREIGN PATENT DOCUMENTS

JP 2010-150897 7/2010

* cited by examiner

*Primary Examiner* — Mary Cheung
*Assistant Examiner* — Frederick Brushaber
(74) *Attorney, Agent, or Firm* — IPUSA, PLLC

(57) ABSTRACT

An electrical swivel working machine includes a lower-part traveling body; an upper-part swivelling body mounted on the lower-part traveling body so as to be rotatable relative to the lower-part traveling body; a swivel mechanism supporting the upper-part swivelling body so that the upper-part swivelling body is rotatable relative to the lower-part traveling body; a motor for sniveling the upper-part swivelling body relative to the lower-part traveling body as a drive source of the swivel mechanism; and a swivel control part generating a drive command for driving the motor, wherein the swivel control part performs a slip prevention mode where a swivel operation of the upper-part swivelling body is mild relative to an ordinary swivel mode.

9 Claims, 8 Drawing Sheets

ELECTRICAL SWIVEL WORKING MACHINE

RELATED APPLICATIONS

This patent application is based upon and claims the benefit of priority of Japanese Patent Application No. 2013-036296 filed on Feb. 26, 2013, the entire contents of which are incorporated herein by reference.

BACKGROUND

1. Field of the Invention

The present invention relates to an electrical swivel working machine including an electric motor as a driving source of an upper-part swivelling body of an electrical swivel working machine.

2. Description of the Related Art

Ordinarily, a lower-part traveling body includes a traveling body including a traveling mechanism used for traveling, and an upper-part swivelling body mounted on the lower-part traveling body. The upper-part swivelling body is operated, by a swivel mechanism. A working machine in which an electrical motor is used as a drive source of the swivel mechanism is called an "electrical swivel working machine" as in, for example, Japanese Laid-open Patent Publication No. 2010-150897.

A crawler may be used as a traveling mechanism of a lower-part traveling body of the working machine. When the crawler contacts the ground, the lower-part traveling body is supported by the ground through the crawler. While the working machine is stopped without traveling, the lower-part traveling body can stop on the ground without traveling relative to the ground by a friction force between the crawler and the ground. With this, if a swivelling reactive force acts on the lower-part travelling body when the upper-part swivelling body swivels on the lower-part traveling body, the lower-part traveling body can maintain the state where the lower-part traveling body is fixed to the ground.

SUMMARY

According to an aspect of the present invention, there is provided an electrical swivel working machine including a lower-part traveling body; an upper-part swivelling body mounted on the lower-part traveling body so as to be rotatable relative to the lower-part traveling body; a swivel mechanism supporting the upper-part swivelling body so that the upper-part swivelling body is rotatable relative to the lower-part traveling body; a motor for swiveling the upper-part swivelling body relative to the lower-part traveling body as a drive source of the swivel mechanism; and a swivel control part generating a drive command for driving the motor, wherein the swivel control part performs a slip prevention mode where a swivel operation of the upper-part swivelling body is mild relative to an ordinary swivel mode.

DETAILED DESCRIPTION

In the above, a friction force between the crawler and the ground is extremely small depending on a working environment and a working machine. In this case, if a great reactive force acts on the lower-part traveling body while the swivel motion of the upper-part swivelling body is accelerated or decelerated, the crawler may slip. Therefore, the lower-part traveling body rotates while the upper-part swiveling body swivels. Thus, there occurs a problem that the swivel operation is not performed as intended by a driver. In particular, when the ground is frozen in a cold region, a friction force between the crawler and the ground is extremely small. Further, when the working machine is operated on an iron plate, a friction force between the crawler and the iron plate becomes small. Therefore, the crawler slips. In particular, when a lifting magnet, a grapple, or the like is attached, the end attachment becomes heavy thereby increasing the centrifugal force. Then, the crawler is apt to slip.

The present invention is provided to solve the above problems. The object of the present invention is to provide an electrical swivel working machine whose lower-part snivel-ing body does not move relative to the ground even if the upper-part swivelling body swivels under a slippery state where a friction force between the crawler and the ground is small or where a centrifugal force is great.

A description is given below, with reference to the FIG. 1 through FIG. 3 of embodiments of the present invention.

Where the same reference symbols are attached to the same parts, repeated description of the parts is omitted.

Figure 1:
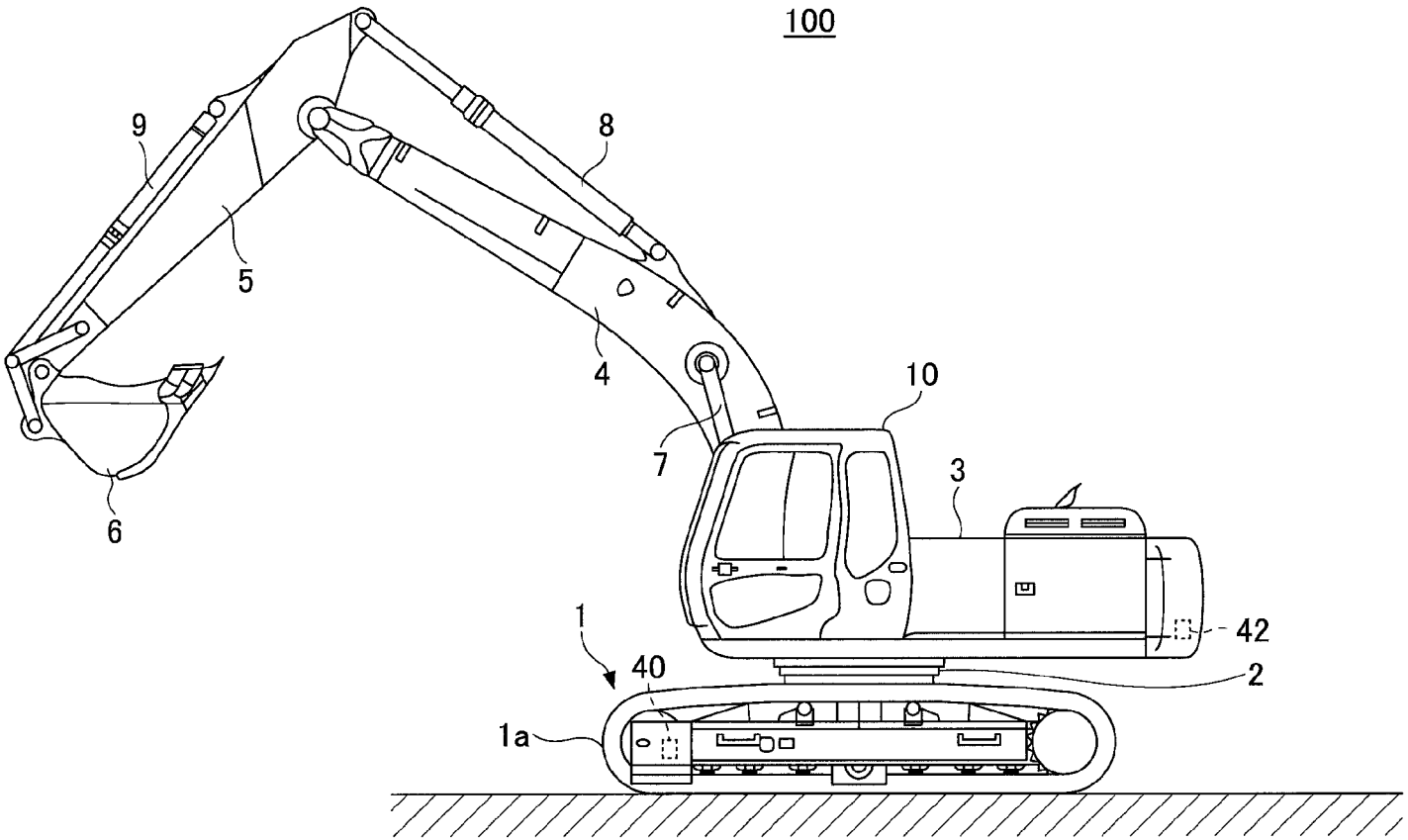
FIG. 1 is a side view of an exemplary electrical swivel working machine to which an embodiment of the present invention is applied.

FIG. 1 is a side view of an exemplary electrical swivel working machine 100, to which an embodiment of the present invention is applied.

Next, embodiments of the present invention are described with reference to figures.

A crawler 1*a* is provided in a lower-part traveling body 1 of the electrical swivel working machine 100 (hereinafter, a working machine). The working machine 100 travels on the ground with the driven crawler 1*a*. An upper-part swivelling body 3 is installed on the lower-part traveling body 1 through a swivel mechanism 2. As described later, the swivel mechanism 2 is driven by an electrical motor to swivel the upper-part swivelling body 3.

A boom 4 is attached to the upper-part swivelling body 3. An arm 5 is attached to an end of the boom 4, and a bucket 6 is attached to the end of the arm 5. The boom 4, the arm 5, and the bucket 6 are hydraulically driven by a boom cylinder 1, an arm cylinder 8, and a bucket cylinder 9, respectively. The upper-part swivelling body 3 has a cabin 10 and a power source such as an engine.

Figure 2:
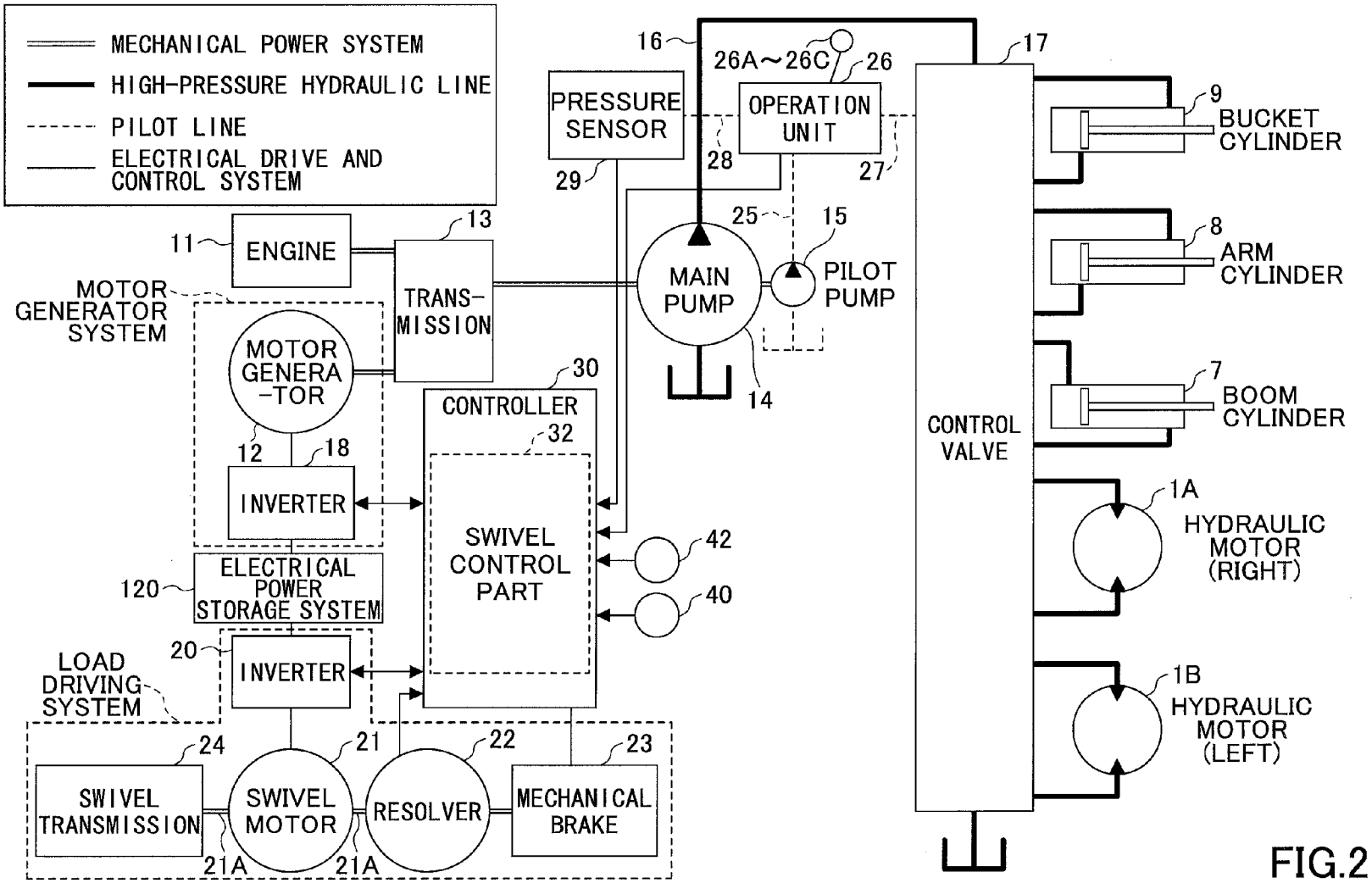
FIG. 2 is a block chart illustrating a drive system of the electrical swivel working machine illustrated in FIG. 1.

FIG. 2 is a block diagram illustrating a drive system of the working machine illustrated in FIG. 1. Referring to FIG. 2, a mechanical power system is indicated by a double line, a high-pressure hydraulic line is indicated by a solid line (a bold line), a pilot line is indicated by a broken line, and an electrical drive and control system is indicated by a solid line (a thin line). Referring to FIG. 2, a hybrid working machine is exemplified. However, a driving method is not limited to a hybrid type as long as the working machine includes a swivel mechanism.

An engine II as a mechanical drive part and a motor generator 12 as an assist drive part are both connected to two input shafts of a transmission 13. A main pump 14 and a pilot pump 15 are connected to an output shaft of the transmission 13. A control valve 17 is connected to the main pump 14 through a high-pressure hydraulic line 16.

The control valve 17 is a control unit that controls a hydraulic system of the working machine. Hydraulic motors 1A (for the right) and 1B (for the left) for the lower-part traveling body 1, the boom cylinder 7, the arm cylinder 8, and the bucket cylinder 9 are connected to the control valve 17 through the high-pressure hydraulic line 16.

An electric power storage system 120 is connected to the motor generator 12 through an inverter 18. A swivel motor 21 as an electrical working element is connected to the electrical power storage system 120 through the inverter 20. A resolver 22, a mechanical brake 23, and a swivel transmission 24 are connected to a rotation shaft 21A of the swivel motor 21. An operation apparatus 26 is connected to the pilot pump 15 via a pilot line 25. A load driving system is formed by the swivel motor 21, the inverter 20, the resolver 22, the mechanical brake 23 and the swivel transmission 24.

The operation apparatus 26 includes a lever 26A, a lever 26B and a pedal 26C. The lever 26A, the lever 26B and the pedal 26C are connected to the control valve 17 and a pressure sensor 29 through hydraulic lines 27 and 28. The pressure sensor 29 is connected to a controller 30 which controls drive of an electric system.

Within the embodiment, a first sensor 40 for detecting a movement of the lower-part traveling body 1 relative to the ground is provided in the lower-part traveling body 1. The first sensor 40 such as a gyro sensor or an acceleration sensor detects movement or motion. A detection signal detected by the first sensor 40 is supplied to the controller 30. Within the embodiment, a second sensor 42 for detecting a movement of the upper-part swivelling body 3 relative to the ground is provided in the upper-part swivelling body 3. The second sensor 42 such as a gyro sensor or an acceleration sensor detects movement or motion. A detection signal detected by the second sensor 42 is supplied to the controller 30. Within the embodiment, a resolver 22 for detecting the revolution of the swivel motor 21 functions as a third sensor for detecting movement (rotation) of the upper-part swivelling body 3 relative to the lower-part travelling body 1. A detection signal obtained by the resolver 22 is supplied to the controller 30.

Hereinafter, the resolver 22 may be called a "third sensor 22".

The controller 30 is a control unit as a main control part for performing a drive control of the working machine. The controller 30 includes an arithmetic processing unit including a central processing unit (CPU) and an internal memory. When the CPU executes a program, for drive control stored, in the internal memory, the controller 30 is substantialized.

The controller 30 performs a drive control (a motor operation (an assist operation) or a generation operation), and simultaneously performs a charge and discharge control of the electrical power storage part of the electrical power storage system 120. The controller 30 performs a charge and discharge control of an electrical power storage part based on a charging condition of the electrical power storage part, an operational condition (the motor operation (the assist operation) or the generation operation) of the motor generator 12, and an operational condition (a power running operation or a regenerating operation) of the swivel motor 21.

The swivel control part 32 provided in the controller 30 converts a signal supplied from the pressure sensor 29 to a speed command as an output command and performs a drive control of the swivel motor 21. The signal supplied from the pressure sensor 29 corresponds to a signal indicative of an operation amount of operating the operation unit 26 for swiveling the swivel mechanism 2. Within the embodiment, the swivel control part 32 generates a speed command to be sent to the swivel motor 21 based on detection signals from the first sensor 40, the second sensor 42, the resolver 22, and so on in addition to the signal supplied from the pressure sensor 29. Within the embodiment, the swivel control part 32 is assembled in the controller 30, However, the swivel control part may be a swivel driving unit provided separate from the controller 30.

Within the embodiment, the swivel, control part 32 controls the speed command to the swivel motor 21 so that the lower-part traveling body 1 does not slip and move by a swivelling reactive force when the lower-part traveling body is in a slippery situation or the lower-part traveling body 1 slips. A swivel mode for controlling as described above is called a "slip prevention mode". A swivel mode other than the "slip prevention mode" is called an "ordinary swivel, mode".

The ordinary swivel mode and the slip prevention mode can be switched over upon an operation of a manual switch by a worker such as a driver of the working machine when necessary. Alternatively, when the working machine itself detects a slip based on detection signals from the above first to third sensors, the controller 30 may automatically switch the swivel mode to the slip prevent ion mode.

When the swivel mode is set to the slip prevention mode, the swivel control part 32 generates a speed command value for the swivel motor 21 so that the acceleration of the upper-part swivelling body 3 at a time of starting and stopping the swivel is smaller than the acceleration in the ordinary swivel mode. Said differently, in the slip preventing mode, a degree of acceleration swivel motion and a degree of deceleration swivel motion are set to be smaller than those in the ordinary swivel mode to reduce the swivelling reactive force acting on the lower-part traveling body 1. Thus, the slip of the lower-part traveling body 1 relative to the ground can be prevented.

Figure 3:
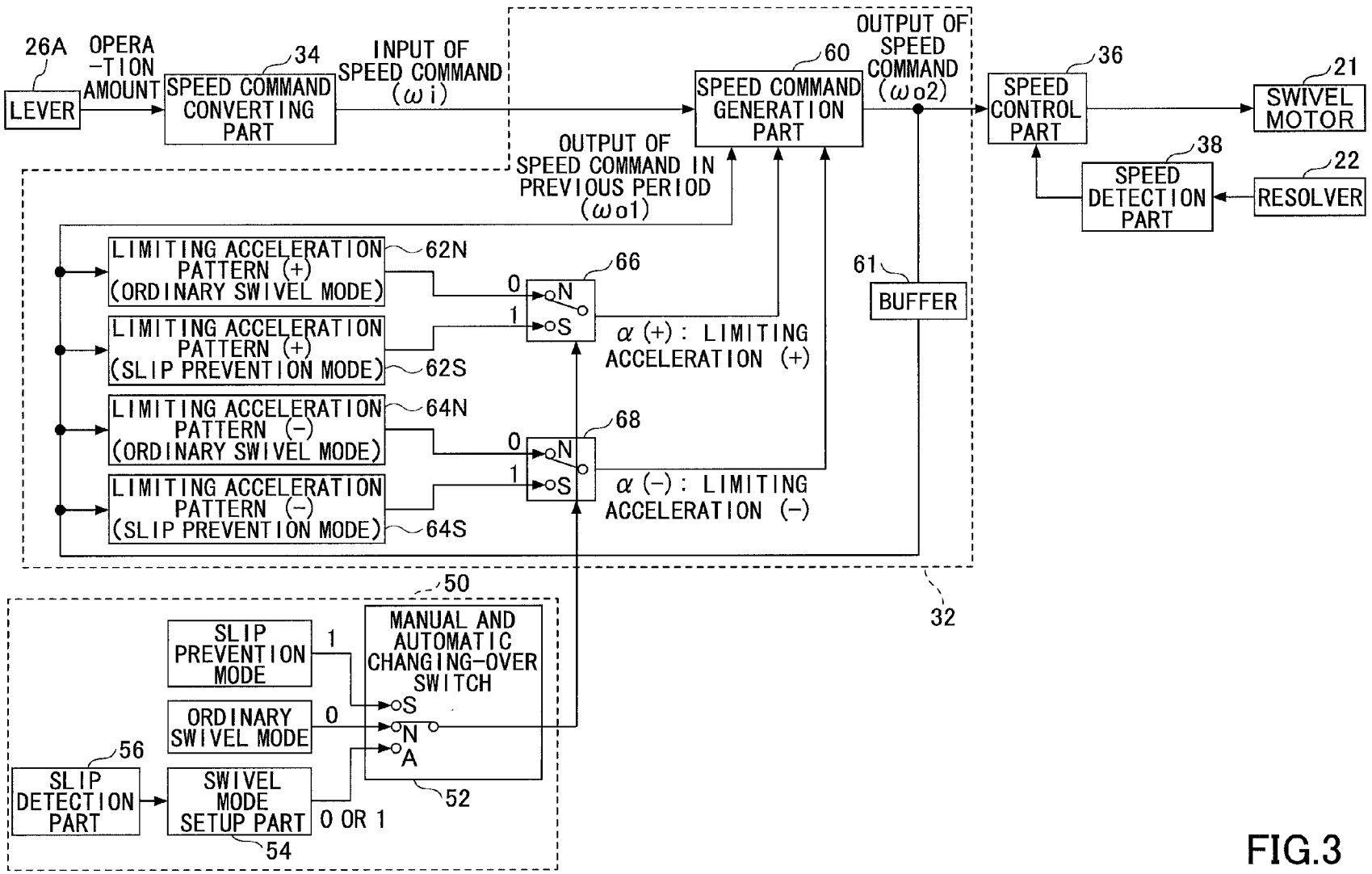
FIG. 3 is a functional block chart of a swivel control part of a controller.

FIG. 3 is a functional block chart of the swivel control part 32 of the controller 30. FIG. 3 illustrates the structure of a swivel mode changing-over part 50.

The swivel mode changing-over part is described first. The swivel mode changing-over part 50 has a function of outputting a switch signal for switching over between the ordinary swivel mode and the slip prevention mode to the swivel control part 32. In order to perform this function, the swivel mode changing-over part 50 includes the manual and automatic changing-over switch 52.

The manual and automatic changing-over switch 52 includes a terminal N for outputting a signal (for example, 0) indicative of the ordinary swivel mode, a terminal S for outputting a signal (for example, 1) indicative of the slip prevention mode, and a terminal A for outputting a signal supplied from a swivel mode setup part 54. The manual and automatic changing-over switch 52 changes over among the terminals N, S, and A to select one of the terminals N, S, and A. The manual and automatic changing-over switch 52 is manually switched by the driver of the working machine or the like.

Therefore, in a case where the manual and automatic changing-over switch 52 is connected to the terminal N, the signal (for example, 0) indicative of the ordinary swivel mode is supplied from the manual and automatic changing-over switch 52 to the swivel control part 32. Further, in a case where the manual and automatic changing-over switch 52 is connected to the terminal S, the signal (for example, 1) indicative of the slip prevention mode is supplied from the manual and automatic changing-over switch 52 to the swivel control part 32.

In a case where the manual and automatic changing-over switch 52 is connected to the terminal A (an automatic setup), one of the signal (for example, 0) indicative of the ordinary swivel mode and the signal (for example, 1) indicative of the slip prevention mode, which signals are output from the swivel mode setup part 54, is supplied from the manual and automatic changing-over switch 52 to the swivel control part 32.

In a case where the first sensor 40 is used as a slip detection part 56, the slip detection part 56 outputs a detection signal output from the first sensor 40 to the swivel mode setup part 54. When the slip (the movement) of the lower-part traveling body 1 is detected by the first sensor 40, this detection signal is output to the swivel mode setup part 54. The swivel mode setup part 54 receiving this detection signal outputs a signal indicative of the slip prevention mode to the terminal A of the manual and automatic changing-over switch 52 because the lower-part traveling body 1 slips. When the first sensor 40 does not detect the slip (the movement) of the lower-part traveling body 1, the swivel mode setup part 54 outputs a signal indicative of the ordinary swivel mode to the terminal A of the manual and automatic changing-over switch 52.

As described, in a case where the manual and automatic changing-over switch 52 is connected to the terminal A, the signal indicative of the ordinary swivel mode or the signal indicative of the slip prevention mode is supplied to the swivel control part 32.

The slip detection part 56 may be structured so that the detection signal is output to the swivel mode setup part 54 based on the detection signals from the above described second sensor 42 and the above described third sensor 22. The slip detection part 56 compares a movement amount of the upper-part swivelling body 3 detected by the second sensor 42 relative to the ground of the upper-part swivelling body 3 with a swivel amount of the upper-part swivelling body 3 detected by the third sensor (the resolver) relative to the lower-part traveling body 1. If this movement amount and this swivel, amount are the same (namely, a difference between the movement amount and the swivel amount is within a predetermined range in the vicinity of zero), it is determined that the slip does not occur in the lower-part traveling body 1 and a signal substantially indicative of zero is output. On the other hand, in a case where the detected movement amount differs (a case where the difference exceeds the predetermined range in the vicinity of zero), it is determined that the lower-part traveling body 1 slips by the difference, and the signal indicative of the value corresponding to the difference (namely, the signal other than zero) is output.

In the case where the output signal from the slip detection part 56 is zero, the swivel mode setup part 54 outputs a signal (for example, 0) indicative of the ordinary swivel mode to the terminal A of the manual and automatic changing-over switch 52. On the other hand, in the case where the output signal from the slip detection part 56 is other than zero, the swivel mode setup part 54 outputs a signal (for example, 1) indicative of the slip prevention mode to the terminal A of the manual and automatic changing-over switch 52.

Next the operation of the swivel control part 32 is described with reference to FIG. 3.

The swivel control part 32 includes a speed command generation part 60 generating a swivelling speed command as an output command from the swivel motor 21, which is provided in the upper-part swivelling body 3. The speed command generation part 60 generates an output of speed command value (ωo2) based on an input of speed command value (ωi) input from a speed command converting part 34 of the controller 30. The speed command generation part 60 outputs the generated output of speed command value (ωo2) to the speed control part 3 6 of the controller 30.

The speed control part 36 generates a current command based on the output of speed command value (ωo2) and supplies the current command to the swivel motor 21. The swivel motor 21 is driven by the current command to drive a swivel mechanism 2. Thus, the upper-part swivelling body 3 is swivelled. The revolution amount of the swivel motor 21 is detected by the resolver 22 and is supplied to a speed detection part 38 of the controller 30. The speed detection part 38 calculates the revolution speed of the swivel motor 21 from the revolution amount detected by the resolver 22 and feeds the calculated revolution speed back to the speed control part 36.

As described, the speed command generation part 60 of the swivel control part 60 has a function of adding a limitation in order to prevent the acceleration caused by the speed command generated from a lever operation amount from being excessive. Within the embodiment, the speed command generation par 60 limits the output of speed command value (ωo2) at the time of the accelerating swivel and the decelerating swivel to thereby make the degrees of the accelerating swivel and the decelerating swivel smaller than the degrees of the accelerating swivel and the decelerating swivel. Hereinafter, the accelerating direction is expressed by the acceleration (+) and the decelerating direction is expressed by the acceleration (−).

The speed command generation part 60 periodically generates the output of speed command value (ωo2) for every predetermined period of time and outputs the generated output of speed command value (ωo2). An output of speed command value (hereinafter, an output of speed command value (ωo2) is input into the speed command generation part 60 through a buffer 61. The speed command generation part 60 calculates an acceleration (α×1) to be applied based on the input of speed command value (ωi) supplied from the speed command converting part 34 and the output of speed command value (ωo1). The output of speed command value (ωo2) output by the speed command generation part 60 based only on the lever operation amount is obtained by adding the acceleration (α×1) to the output of speed command value (ωo1). However, within the embodiment, in a case where the slip prevention mode is set, the speed command generation part 60 calculates the output of speed command value (ωo2) by adding the an acceleration equal to or less than the limited acceleration (a limiting acceleration (60 )) to the output of speed command value (ωo2). Hereinafter, the limiting acceleration pattern includes a limiting deceleration pattern.

The limiting acceleration (α) is extracted from a preset limiting acceleration pattern. Specifically, the limiting acceleration (α(+)) supplied to the speed command generation part 60 during the acceleration is a limiting acceleration supplied from the limiting acceleration pattern (+) 62N or 62S. The limiting acceleration pattern (+) 62N stores the limiting acceleration (α(+)), which is to be output in a case where the ordinary swivel mode is set, as map information corresponding the speed command. The limiting acceleration pattern (+) 62N supplies the limiting acceleration (α(+)) in the ordinary swivel mode to the terminal N of the switch 66. The limiting acceleration pattern (+) 62S stores the limiting acceleration (α(+)), which is to be output in a case where the slip prevention mode is set, as map information corresponding the speed command. The limiting acceleration pattern (+) 62S supplies the limiting acceleration (α+)) in the slip prevention mode to the terminal S of the switch 66.

A signal is applied from the manual and automatic changing-over switch 52 of the above swivel mode changing-over part 50 to the switch 66. The signal from the manual and automatic changing-over switch 52 is a signal (for example, 0) indicative of the ordinary swivel mode, the switch 66 is switched to the terminal N. Then the value of the limiting acceleration (α(+)) from the limiting acceleration pattern (+) 62N used in the ordinary swivel mode is output from the switch 66 and is supplied to the speed command generation part 60. The signal from the manual and automatic changing-over switch 52 is a signal (for example, 1) indicative of the slip prevention mode, the switch 66 is switched to the terminal S. Then the value of the limiting acceleration (α(+)) from the limiting acceleration pattern (+) 62S used in the slip prevention mode is output from the switch 66 and is supplied to the speed command generation part 60.

Here, the value of the limiting acceleration (α(+)) in the slip prevention mode supplied from the limiting acceleration pattern (+) is an acceleration limited to be a small value so that the slip is not caused even if the working machine is located at a place easily causing a slip. Therefore, the speed command generation part 60 generates the output of speed command value (ωo2) using the limiting acceleration (α(+)), which is limited to a value smaller than the ordinary value, when the slip prevention mode is set. Thus, the degree of accelerating swivel in the slip prevention mode can foe suppressed. With this, it is possible to restrict the swivelling reactive force acting on the lower-part travelling body 1 at the time of starting swivelling in the slip prevention mode. Therefore, the slip of the lower-part traveling body 1 can be prevented.

Specifically, the limiting acceleration (60 (−)) supplied to the speed command generation part 60 during the deceleration is a limiting acceleration supplied from the limiting acceleration pattern (+) 64N or 64S. The limiting acceleration pattern (−) 64N stores the limiting acceleration (α(31 )), which is to be output in a case where the ordinary swivel mode is set, as map information corresponding the speed command. The limiting acceleration pattern (31 ) 64N supplies the limiting acceleration (60 (−)) in the ordinary swivel mode to the terminal N of the switch 68. The limiting acceleration pattern (−) 64S stores the limiting acceleration (60 (−)), which is to foe output in a case where the slip prevention mode is set, as map information corresponding the speed command. The limiting acceleration pattern (60 (−)) 64S supplies the limiting acceleration (α(−)) in the slip prevention mode to the terminal S of the switch 68.

A signal is applied from the manual, and automatic changing-over switch 52 of the above swivel mode changing-over part 50 to the switch 68. The signal from the manual and automatic changing-over switch 52 is a signal (for example, 0) indicative of the ordinary swivel mode, the switch 68 is switched to the terminal N. Then, the value of the limiting acceleration (α(−)) from the limiting acceleration pattern (−) 64N used in the ordinary swivel mode is output from the switch 68 and is supplied to the speed command generation part 60. The signal from the manual and automatic changing-over switch 52 is a signal (for example, 1) indicative of the slip prevention mode, the switch 68 is switched to the terminal S. Then the value of the limiting acceleration (α(−)) from the limiting acceleration pattern (−) 64S used in the slip prevention mode is output from the switch 68 and is supplied to the speed command generation part 60.

Here, the value of the limiting acceleration (α(−)) in the slip prevention mode supplied from the limiting acceleration pattern (−) is an acceleration limited to be a small value so that the slip is not caused even if the working machine is located at a place easily causing a slip. Therefore, the speed command generation part 60 generates the output of speed command value (ωo2) using the limiting acceleration (α(−)), which is limited to a value smaller than the ordinary value, when the slip prevention mode is set. Thus, the degree of decelerating swivel in the slip prevention mode can be suppressed. With this, it is possible to restrict the swivelling reactive force acting on the lower-part travelling body 1 at the time of stopping swivelling in the slip prevention mode. Therefore, the slip of the lower-part traveling body 1 can be prevented.

Figure 4:
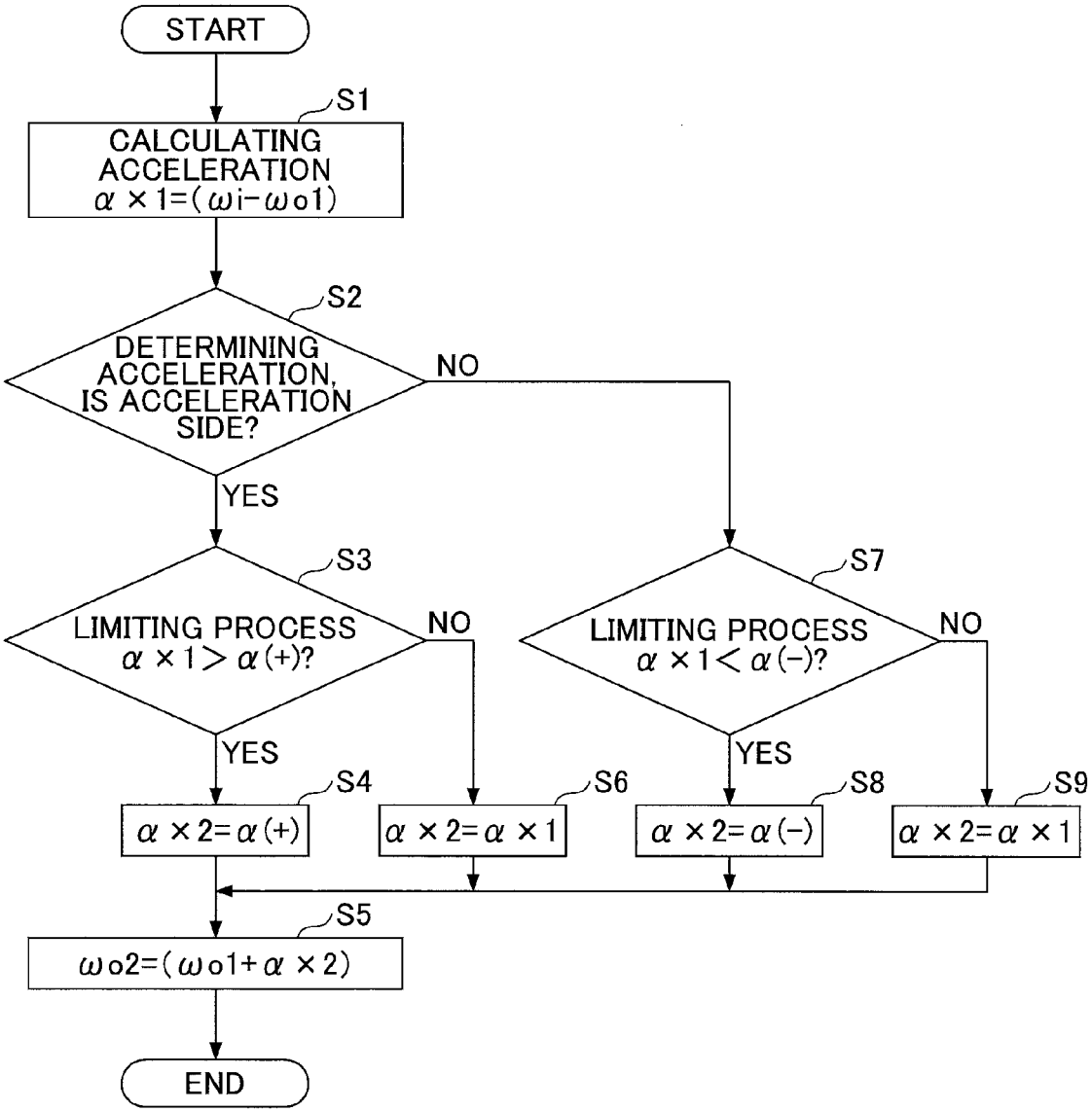
FIG. 4 is a flow chart of a speed command generating process.

Here, the process of generating the output of speed command value (ωo2) is described with reference to FIG. 4. FIG. 4 is a flowchart of the process of generating the output of speed command value.

After the process of generating the output of speed command value is started, the speed command generation part 60 of the swivel control part 32 calculates an acceleration acquired from the input of speed command value ωi, which is determined based on only the lever operation amount as an acceleration (α×1) in step S1. The acceleration corresponding to the speed command can be acquired by subtracting an output ωo1 of speed command in previous period from the input of speed command value ωi (α×1-ωi-ωo1).

Next, in step S2 the speed command generation part 60 determines the direction of acceleration (acceleration or deceleration). The determination of the direction is performed based on the sign of the acceleration (α×1). Namely, if the acceleration (α×1) has a positive value (+), the speed is increased, and a change in the speed command is determined to be in the direction of the acceleration. If the acceleration (α×1) has a negative value (−), the speed is decreased, and a change in the speed, command is determined to be in the direction of the deceleration.

In step S2, if the change in the speed command is determined to be in the direction of the acceleration (YES in step S2), the process goes to step S3. In step S3, the speed command generation part 60 determines whether the acceleration (α×1) is greater than the limiting acceleration (α(+). The limiting acceleration (α(+)) used at this time is determined based on a switching status of the switch 66. If the ordinary swivel mode is set, the used limiting acceleration (α(+)) is that output from, the limiting acceleration pattern (+) 62N in the ordinary swivel mode. On the other hand, when the slip prevention mode is set, the limiting acceleration (α(+)) output from the limiting acceleration pattern (+) 62S is used.

When it is determined that the acceleration α×1is greater than the limiting acceleration (α(+)) in YES of step S3, the process moves to step S4. In step S4, the acceleration (α×2) to be set at this time is made the limiting acceleration (α(+)).

In step S5, the speed command generation part 60 adds the acceleration (α×2) to the output of speed command in previous period (ωo1) to generate the output of speed command (ωo2) to be output at this time and supply the generated output of speed command in previous period (ωo2) to the speed control part 36.

According to the process from step S3, step S4, and step S5, the acceleration (α×2) used this time is limited to the limiting acceleration (α(+)) output from the limiting pattern (+) 62N or 62S. Therefore, when the slip prevention mode is set, the limiting acceleration (α×2) output from the limiting acceleration pattern (+) 62S is limited to the limiting acceleration (α(+)) smaller than that output from the limiting acceleration pattern (+) 62S. With this, it is possible to restrict the swivelling reactive force acting on the lower-part travelling body 1 at the time of accelerating swivel in the slip prevention mode. Therefore, the slip of the lower-part traveling body 1 can be prevented.

When it is determined that the acceleration $\alpha\times1$ is smaller than the limiting acceleration (+) in NO of step S3, the process moves to step S6. In step S6, the acceleration ($\alpha\times2$) to be set at this time is made equal to the acceleration ($\alpha\times2$) calculated in step S1. Said differently, the acceleration ($\alpha\times2$) to be set at this time is not limited to the limiting acceleration ($\alpha(+)$) output from the limiting acceleration pattern (+) 62N or 62S, and is maintained to be the acceleration ($\alpha\times1$) obtained from the lever operation amount ($\alpha\times2=\alpha\times1$).

The process moves to step S5. In step S5, the speed command generation part 60 adds the acceleration ($\alpha\times2$) to the output of speed command in previous period ($\omega o1$) to generate the output of speed command ($\omega o2$) to be output at this time and supply the generated output of speed command ($\omega o2$) to be output at this time to the speed control part 36.

According to the process of step S3, step S6, and step S5, because the acceleration ($\alpha\times1$) obtained from the lever operation amount is smaller than the limiting acceleration ($\alpha(+)$) output from the limiting acceleration pattern (+) 62N or 62S. Therefore, it is unnecessary to limit the acceleration ($\alpha\times1$). Therefore, the acceleration ($\alpha\times1$) obtained from the lever operation amount is used as is to generate the output of speed command value ($\omega o2$).

In step S2, if the change in the speed command is determined to be in the direction of the deceleration (NO in step S25, the process goes to step S7. In step S7, the speed command generation part 60 determines whether the acceleration ($\alpha\times1$) is greater than the limiting acceleration ($\alpha(-)$). The limiting acceleration ($\alpha(-)$) used at this time is determined based on the switching status of the switch 68. If the ordinary swivel mode is set, the used limiting acceleration ($\alpha(-)$ is that output from the limiting acceleration pattern (−) 64N in the ordinary swivel mode. On the other hand, when the slip prevention mode is set, the limiting acceleration ($\alpha(-)$) output from the limiting acceleration pattern (−) 64S is used.

When it is determined that the acceleration $\alpha\times1$ is smaller than the limiting acceleration ($\alpha(-)$) in YES of step S7, the process moves to step S8. In step S8, the acceleration ($\alpha\times2$) to be set at this time is made the limiting acceleration ($\alpha(-)$).

The process moves to step S5. In step S5, the speed command, generation part 60 adds the acceleration ($\alpha\times2$) to the output of speed command in previous period ($\omega o1$) to generate the output of speed command ($\omega o2$) to be output at this time and supply the generated output of speed command ($\omega o2$) to be output at this time to the speed control part 36.

According to the process of step S7, step S8, and step SS, the acceleration ($\alpha\times2$) used this time is limited to the limiting acceleration ($\alpha(-)$) output from the limiting pattern (−) 64N or 64S. Therefore, when the slip prevention mode is set, the limiting acceleration ($\alpha\times2$) output from the limiting acceleration pattern (−) 64S is limited to the limiting acceleration (60 (−)) smaller than the ordinary. With this, it is possible to restrict the swivelling reactive force acting on the lower-part travelling body 1 at the time of stopping swivelling in the slip prevention mode. Therefore, the slip of the lower-part traveling body 1 can be prevented.

When it is determined that the acceleration $\alpha\times1$ is greater than the limiting acceleration (−) in NO of step S7, the process moves to step S3. In step S9, the acceleration ($\alpha\times2$) to be set at this time is made equal to the acceleration ($\alpha\times1$)) calculated in step S9. Said differently, the acceleration ($\alpha\times2$) to be set at this time is not limited to the limiting acceleration ($\alpha(-)$) output from the limiting acceleration pattern (−) 64N or 645, and is maintained to be the acceleration ($\alpha\times1$) obtained from the lever operation amount ($\alpha\times2=\alpha\times1$).

The process moves to step S5. In step S5, the speed command generation part 60 adds the acceleration ($\alpha\times2$) to the output of speed command in previous period ($\omega o1$) to generate the output of speed command ($\omega o2$) to be output at this time and supply the generated output of speed command ($\omega o2$) to be output at this time to the speed control part 36.

According to the process of step S7, step S9, and step S5, because the acceleration ($\alpha\times1$) obtained from the lever operation amount is smaller than the limiting acceleration ($\alpha(-)$) output from the limiting acceleration pattern (−) 64N or 64S. Therefore, it is unnecessary to limit the acceleration ($\alpha\times1$). Therefore, the acceleration ($\alpha\times1$) obtained from the lever operation amount is used as is to generate the output of speed command value ($\omega o2$).

Next, the limiting acceleration pattern is described.

Figure 5:
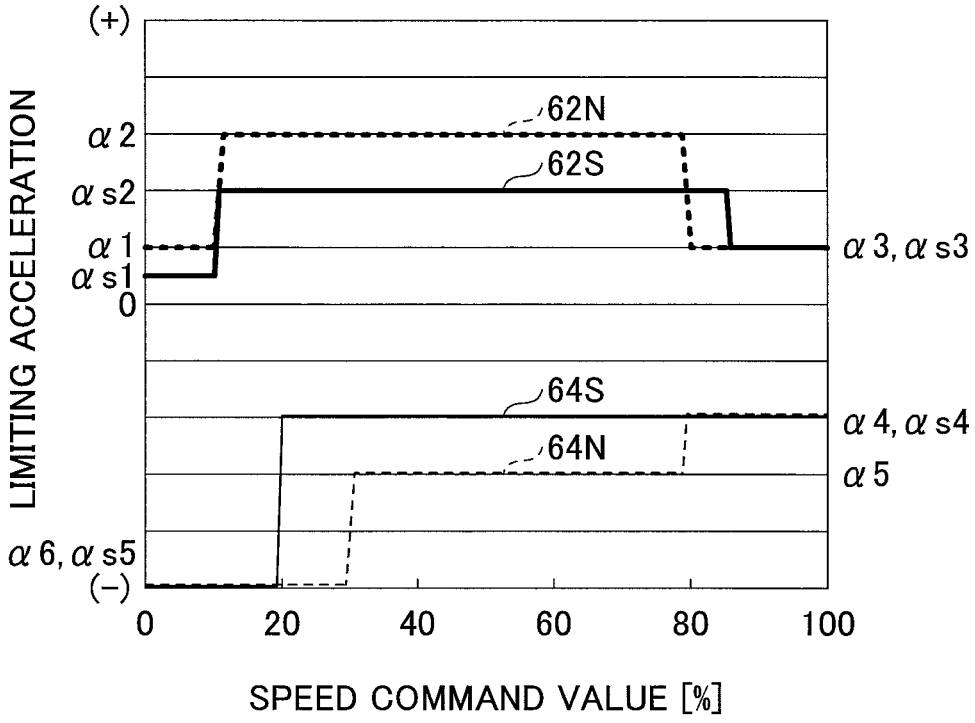
FIG. 5 illustrates an example of an acceleration pattern.

FIG. 5 illustrates the limiting acceleration patterns (+) 62N and 62S and the limiting acceleration patterns (+) 64N and 64S. The abscissa axis of the graph illustrated in FIG. 5 represents a speed command value (%). The maximum value of the speed command value is 100%. The ordinate axis of the graph illustrated in FIG. 5 represents the value of the limiting acceleration. An upper part upper than zero in the ordinate axis is an acceleration side (the limiting acceleration (+). A lower part lower than zero in the ordinate axis is a deceleration side (the limiting acceleration (−)).

On the upper side of FIG. 5, the limiting acceleration pattern (+) 62N in the ordinary swivel mode is indicated by a bold dot line, and the limiting acceleration pattern (+) 62S in the slip prevention mode is indicated by a bold solid line. On the lower side of FIG. 5, the limiting acceleration pattern (−) 64N in the ordinary swivel mode is indicated by a narrow dot line, and the limiting acceleration pattern (−) 64S in the slip prevention mode is indicated by a narrow solid line.

Figure 6:
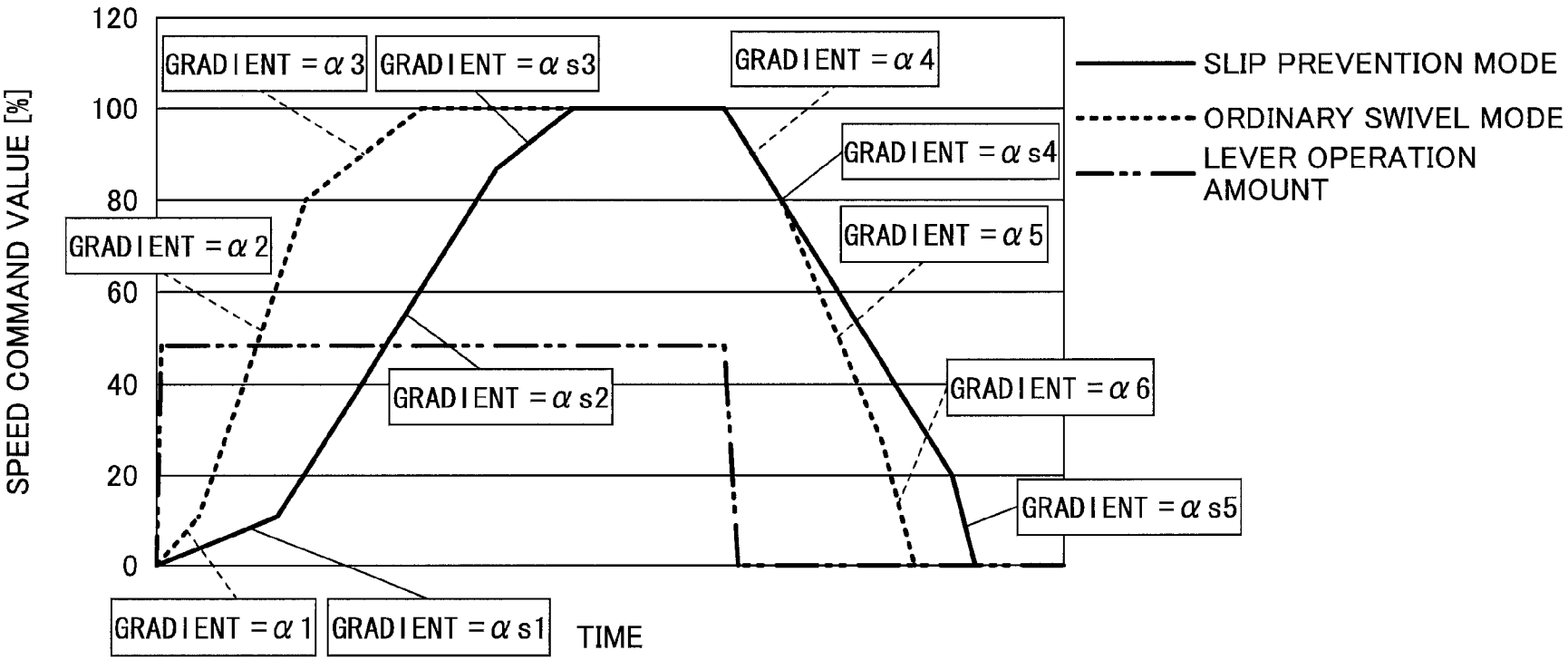
FIG. 6 is a graph illustrating a change of a speed command value in controlling the swivelling speed using the limiting acceleration pattern illustrated in FIG. 5.

FIG. 6 is a graph illustrating a change of the speed command value in controlling a swivelling speed using the limiting acceleration pattern illustrated in FIG. 5. The speed command value illustrated in FIG. 6 corresponds to the actual swivelling speed of the upper-part swivelling body 3. A change of the speed command value in the ordinary swivel mode is indicated by a dot line, and a change of the speed command value in the slip prevention mode is indicated by a solid line. The operation amount of a swivel operation lever is represented by a two-dot chain line.

For example, on the acceleration side in FIG. 5, the value of the limiting acceleration (+) is $\alpha$1 in the ordinary swivel mode and the value of the limiting acceleration (+) is $\alpha$s1 in the slip prevention mode from the generation of the speed command after the swivel operation lever is operated until the speed command is 10% of the maximum value. The value $\alpha$s1 of the limiting acceleration (+) in the slip prevention mode is set smaller than the value $\alpha$s1 of the limiting acceleration (+) in the ordinary swivel mode. Therefore, when the speed command value $\omega$ is between 0% to 10%, the acceleration in the slip prevention mode is set to be smaller than the acceleration in the ordinary swivel mode.

In the ordinary swivel mode, the value of the limiting acceleration (+) is $\alpha$2 after the speed command exceeds 10% of the maximum value of the speed command and reaches 80%. Further, in the slip prevention mode, the value of the limiting acceleration (+) is $\alpha$s2 after the speed command exceeds 10% of the maximum value of the speed command and reaches 85% (slightly greater than 80%). The value $\alpha$s2 of the limiting acceleration (+) in the slip prevention mode is set smaller than the value $\alpha$2 of the limiting acceleration (+) in the ordinary swivel mode. Therefore, when the speed command value to is between 10% to 80%, the acceleration in the slip prevention mode is set to be smaller than the acceleration in the ordinary swivel mode.

As described above, the degree of accelerating swivel is suppressed to be small in the slip prevention mode until the swivelling speed reaches a certain level or the maximum swivelling speed after the swivel operation lever is operated, the the speed command is generated, and the upper-part swivelling body 3 is started being operated. With this, the swivelling reactive force acting on the lower-part traveling body 3 by the accelerating swivel of the upper-part swivelling body 3 is suppressed to be small thereby suppressing the slip of the lower-part traveling body 1.

As illustrated in FIG. 6, in a case where the speed command value to reaches 100% (the maximum value), until the speed command value ω is changed from 80% in the ordinary swivel mode or 83% in the slip prevention mode to 100%, the values α3 and αs3 of the limiting acceleration (+) are the same value and set smaller than the previous values α2 and αs2. This is to attain the maximum swivelling speed while preventing an abrupt decrement of the acceleration.

When the operator returns the swivel operation lever to the neutral position in order to stop the swivel, the swivel operation is determined to be on the deceleration side in the speed command generating process illustrated in FIG. 4. Therefore, the limiting acceleration (−) is added to the speed command value ω. Therefore, the speed command value ω gradually decreases.

In a case where the ordinary swivel mode is set, if the speed command value decreases down to 80%, the value of the limiting acceleration (−) increases from α4 to α5 slightly greater than α4. Said differently, when the deceleration becomes smaller than 80%, the deceleration increases as if braking is abruptly applied. On the other hand, when the slip prevention mode is set, the value of the limiting acceleration (−) remains to be αs4 (equal to α4) until the speed command value becomes 20%. Then, the deceleration becomes smaller than the ordinary swivel mode. Thus, the deceleration is set to be mild.

As described, when the swivel operation lever is returned to the neutral position to stop the swivel, the degree of deceleration swivel can be suppressed to be small until the swivelling speed becomes small, to a certain level under the slip prevention mode. With this, the swivelling reactive force acting on the lower-part traveling body 1 by the accelerating swivel of the upper-part swivelling body 3 is suppressed to be small thereby suppressing the slip of the lower-part traveling body 1.

As described, if the degree of decelerating swivel is continuously suppressed to be small, the swivel slowly stops and the upper-part swivelling body 3 cannot stop at a swivel stop position intended by the operator to cause an excessive overrun. Within the embodiment, when the slip prevention mode is set, the deceleration is set to be αs5, which is a great value, when the speed command value is 20% to promote the stop of swivel. In the ordinary swivel mode, the deceleration is set to be α5 when the speed command value becomes 30%, and in the slip prevention mode, the deceleration is set to be αs5 when the speed command value becomes 20%. With this, the swivelling reactive force is suppressed when the deceleration of the upper-part swivelling body 3 is set to be αs5, which is a great value and equals to α6. Thus, the slip of the lower-part traveling body 1 can be suppressed. The limiting acceleration pattern illustrated in FIG. 5 can be variously changed in response to the working environment of the working machine.

Figure 7:
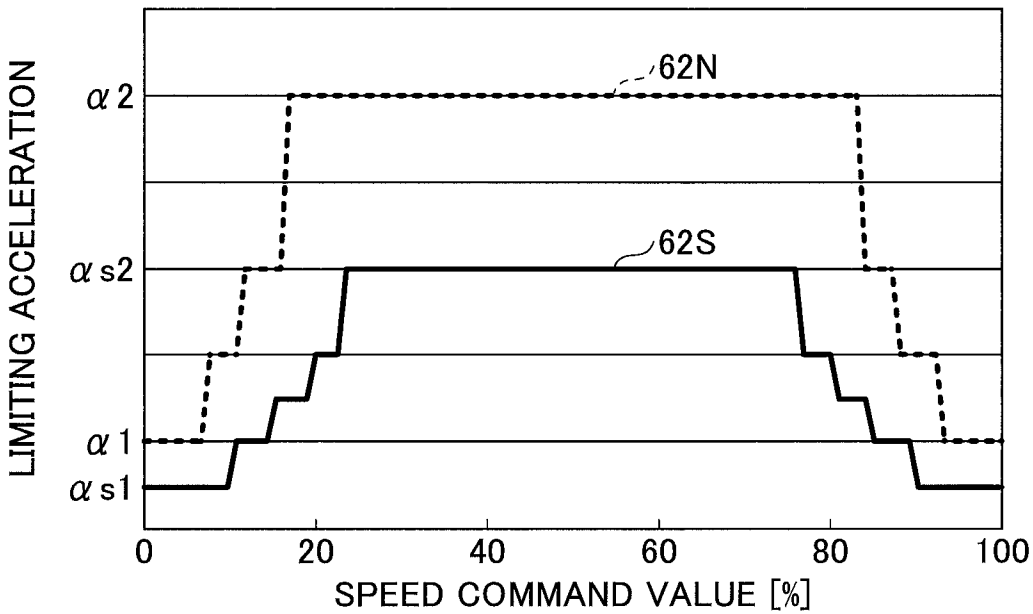
FIG. 7 illustrates another example of the limiting acceleration pattern.
Figure 8:
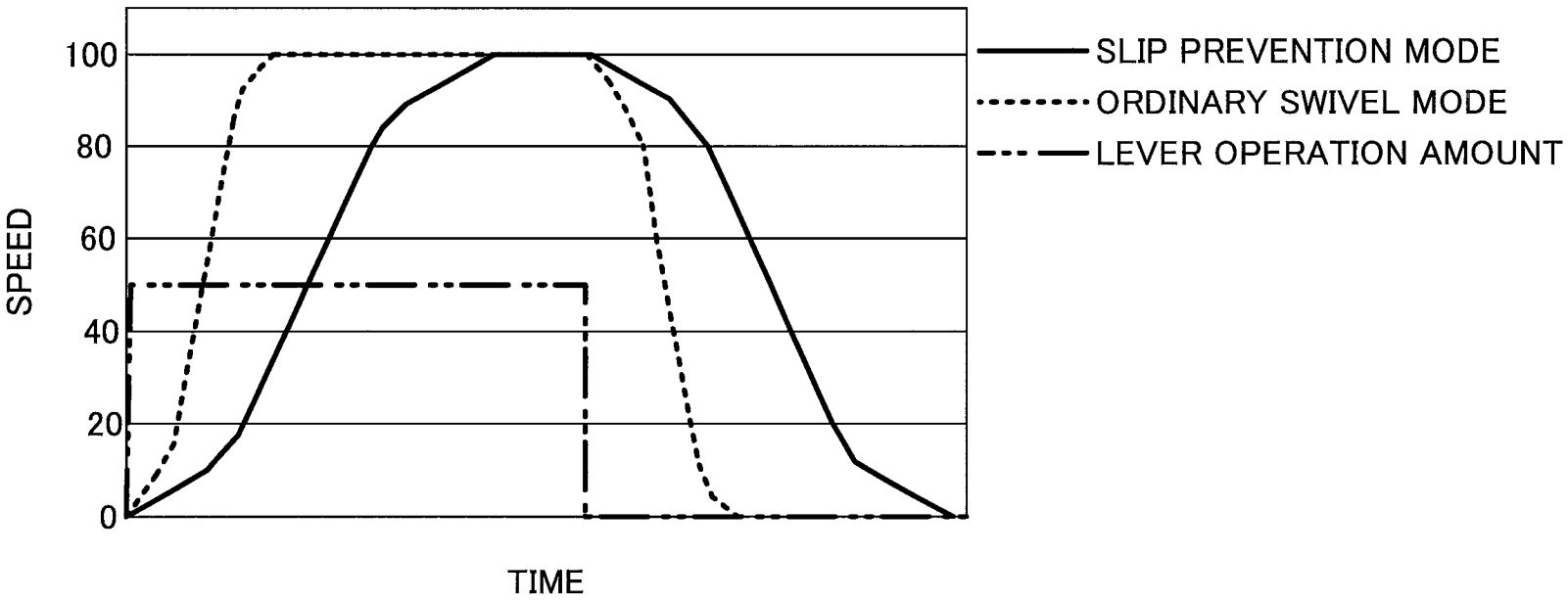
FIG. 8 is a graph illustrating a change of a speed command value in controlling the swivelling speed using the limiting acceleration pattern illustrated in FIG. 7.

Next, another example of the limiting acceleration pattern illustrated in FIG. 5 is described with reference to FIGS. 7 and 8. FIG. 7 illustrates another example of the limiting acceleration pattern. FIG. 8 is a graph illustrating a change of the speed command value in controlling the swivelling speed using the limiting acceleration pattern illustrated in FIG. 7.

As illustrated in FIG. 7, the acceleration is increased in a stepwise fashion so as to reach the maximum swivelling acceleration, then, the acceleration is decreased in a stepwise fashion so as to reach a predetermined acceleration, and then the acceleration is decreased gradually in a step wise fashion when the speed reaches the maximum speed. With this change of the acceleration in the step wise fashion, the swivelling speed of the upper-part swivelling body 3, namely the speed command value ω, can smoothly change as illustrated in FIG. 8. With this, it is possible to restrict the swivelling reactive force acting on the lower-part travelling body 1 when the acceleration changes. Therefore, the slip of the lower-part traveling body 1 can be prevented.

FIG. 7 illustrates the limiting acceleration pattern after the swivel starts until the swivelling speed reaches a predetermined speed. A control of the acceleration in the step wise fashion in a manner similar to the above can be applied to a limiting deceleration pattern from a predetermined swivelling speed to the stop of the upper-part swivelling body 3.

Within the embodiment, an example that the speed command is used as the output command to be changed is illustrated. However, a torque command value may be used as an output command to be changed.

Further, within the embodiment, a bucket is used as the end attachment. However, a lifting magnet, a grapple or the like may be attached. In this case, because the end attachment is heavier than the bucket, the centrifugal force increases and the working machine is apt to slip. However, by applying the present invention, it is possible to suppress a slip from causing between the crawler and an iron plate.

Further, in a case where a suspending grapple is used, there may occur a problem that the amplitude of the grapple becomes great when the swivel is stopped. In this case also, by applying the present invention, the output of the swivel is made mild and the amplitude of the grapple at the time of stopping the swivel can be made small. As described, a mode of reducing the amplitude is included in the slip prevention mode.

Reference symbols typically designate as follows:

1: lower-part traveling body;
1*a*: crawler;
1A, 1B: hydraulic motor;
2: swivel mechanism;
3: upper-part swivelling body;
A: boom;
5: arm;
6: bucket;
7: boom cylinder;
8: arm cylinder;
9: bucket cylinder;
10: cabin;
11: engine;
12: motor generator;
13: transmission;
14: main pump;
15: pilot pump;
16: high-pressure hydraulic line;
17: control valve;
18, 20: inverter;
21: swivel motor;
22: resolver;

23: mechanical brake;
24: swivel transmission;
25: pilot line;
26: operation apparatus;
26A, 26B: lever;
26C: pedal;
27: hydraulic line;
28: hydraulic line;
29: pressure sensor;
30: controller;
32: swivel control part;
34: speed command converting part;
36: speed control part;
38: speed detection part;
40: first sensor;
42: second sensor;
50: swivel mode changing-over part;
52: manual and automatic changing-over switch;
54: swivel mode setup part;
56: slip detection part;
60: speed command generation part;
61: buffer;
62S, 62N: limiting acceleration pattern (+);
64S, 64N: limiting acceleration pattern (−);
66, 68: switch; and
120: electrical power storage system.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the electrical swivel working machine has been described in detail, it should be understood that the various changes, substitutions, and alterations could be made hereto without departing from the spirit and scope of the invention.

What is claimed is:

1. An electrical swivel working machine comprising:

a lower-part traveling body;

an upper-part swivelling body mounted on the lower-part traveling body so as to be rotatable relative to the lower-part traveling body;

a swivel mechanism supporting the upper-part swivelling body so that the upper-part swivelling body is rotatable relative to the lower-part traveling body;

a motor for swiveling the upper-part swivelling body relative to the lower-part traveling body as a drive source of the swivel mechanism; and a swivel control part generating a drive command for driving the motor, wherein the swivel control part performs a slip prevention mode where a swivel operation of the upper-part swivelling body is slow relative to an ordinary swivel mode so as to prevent a slip between a ground surface and a tread of the electrical swivel working machine.

2. The electrical swivel working machine according to claim 1, wherein, when the slip prevention mode is set, the swivel control part generates an output command value whose absolute value is smaller than an output command value in the ordinary swivel mode corresponding to an operation amount received from an operation unit.

3. The electrical swivel working machine according to claim 2, wherein the output command value is a speed command value, and the swivel control part generates a new speed command value by adding a limiting acceleration to the speed command value.

4. The electrical swivel working machine according to claim 3, wherein the swivel control part includes a pattern of limiting acceleration corresponding to the speed command value.

5. The electrical swivel working machine according to claim 3, wherein, when the swivel mode is switched to the slip prevention mode, the swivel control part generates the speed command value so as to suppress an output torque from the motor.

6. The electrical swivel working machine according to claim 1, wherein the slip prevention mode and the ordinary swivel mode are manually switched over.

7. The electrical swivel working machine according to claim 1, wherein the slip prevention mode and the ordinary swivel mode are automatically switched over.

8. The electrical swivel working machine according to claim 7, further comprising:

a first sensor detecting a motion of the lower-part traveling body relative to a ground, wherein the swivel control part detects a slip of the lower-part traveling body based on a detection signal from the first sensor.

9. The electrical swivel working machine according to claim 7, further comprising:

a second sensor detecting a motion of the upper-part swivelling body relative to the ground; and a third sensor detecting a motion of the upper-part swivelling body relative to the lower-part traveling body, wherein the swivel control part detects a slip of the lower-part traveling body relative to the ground based on detection signals from the second and third sensors.

* * * * *